United States Patent [19]

Krebs

[11] 3,991,738

[45] Nov. 16, 1976

[54] OVEN DOORS

[75] Inventor: Jacob Krebs, St. Clair Shores, Mich.

[73] Assignee: Shatterproof Glass Corporation, Detroit, Mich.

[22] Filed: Jan. 22, 1975

[21] Appl. No.: 543,062

[52] U.S. Cl. ..... 126/200

[51] Int. Cl.[2] ..... F23M 7/00

[58] Field of Search ..... 126/200; 49/463, 465; 52/616

[56] References Cited

UNITED STATES PATENTS

| | | | |
|---|---|---|---|
| 1,017,196 | 2/1912 | Baldian | 126/200 |
| 2,003,982 | 6/1935 | Swanson | 126/200 |
| 2,226,254 | 12/1940 | Owen | 126/200 |
| 2,325,773 | 8/1943 | Hennessy | 126/200 |
| 2,394,176 | 2/1946 | Hillebrand | 126/200 |
| 2,580,957 | 1/1952 | Reeves | 126/200 |
| 2,628,877 | 2/1953 | Woo | 312/138 R |
| 3,088,453 | 5/1963 | Grahn et al. | 126/200 |
| 3,177,334 | 4/1965 | Kinkle | 126/200 |
| 3,892,224 | 7/1975 | McKelvey | 126/200 |

*Primary Examiner*—John J. Camby
*Assistant Examiner*—Larry I. Schwartz
*Attorney, Agent, or Firm*—William E. Nobbe

[57] ABSTRACT

An oven door comprising front and back metal door panels having a central opening therein to provide a window for see-through into the oven compartment. A window unit is mounted in the window opening and comprises inner and outer transparent glass panels mounted in spaced, parallel relation in a common supporting frame. The inner glass panel is fixed in said frame while the outer glass panel is removably mounted therein. Means is provided for releasably securing the outer glass panel in said frame such that it can be readily removed for replacement or for cleaning the inner surfaces of the panels without disturbing the inner glass panel, the supporting frame, or the oven door proper.

17 Claims, 11 Drawing Figures

OVEN DOORS

BACKGROUND OF THE INVENTION

This invention relates to an oven door of the type incorporating a window means through which the oven interior may be viewed when the door is in closed position to observe the advance of the cooking process.

It has heretofore been the common practice to provide a double-glazed window unit for the oven door embodying inner and outer transparent glass panels mounted in spaced, parallel relation in a metal supporting frame. The two glass panels are secured in fixed position in the frame to provide a substantially dead-air space therebetween. This type of window unit has the serious objection that neither glass panel can be removed for replacement or to permit cleaning of the inner surfaces of said panels without first removing the entire window unit from the oven door and substantially completely disassembling the same.

It has been proposed to overcome this problem by mounting the two glass panels in separate frames, with the outer frame being independently hinged so that the outer glass panel can be swung relative to the inner glass panel to permit access to the space between said panels. However, none of the known devices of this type have fully satisfactorily solved this problem. Thus, such a device has the serious disadvantages of increased weight, greater number of parts, relatively high cost and poor aesthetics.

SUMMARY OF THE INVENTION

The present invention comprehends an improved oven door and more particularly a window unit therefore which avoids the disadvantages of the above discussed prior art devices.

More specifically, the invention comprehends a double-glazed window unit embodying inner and outer transparent glass panels mounted in spaced, parallel relation in a common supporting frame. The inner glass panel is fixed in said frame, while the outer glass panel can be readily removed for replacement or to permit cleaning of the inner surfaces of said panels. The supporting frame is preferably made of a light-weight metal and is formed with inner and outer substantially continuous U-shaped channels defining the opening therein and adapted to receive the marginal edge portions of the inner and outer glass panels respectively. The inner glass panel is fixedly secured in the inner channel and the outer glass panel removably received in the outer channel.

The outer glass panel has a horizontal dimension slightly less than that of the window opening in the supporting frame so that when said panel is inserted in said frame it will clear the sides thereof. More specifically, when inserting the glass panel in the supporting frame, it is tilted forwardly and the bottom edge portion thereof placed in that portion of the outer channel at the bottom of the frame. The upper portion of said glass panel is then moved rearwardly to a vertical position in alignment with that portion of the outer channel at the top of the frame. The panel is then released and spring means located in the bottom channel will urge the panel upwardly and the upper edge portion thereof into the upper channel to releasably secure the same therein.

In order to permit the top edge of the outer glass panel to clear the upper channel upon insertion of said panel in the frame the vertical dimension of the said panel is somewhat less than the distance between the bottoms of the channels at the top and bottom of the frame. When the glass panel is to be removed, it is initially force downwardly against the action of the spring means in the bottom channel until the top edge of the panel clears the upper channel, whereupon the panel can be tilted forwardly and lifted out of the channel at the bottom of the frame.

The window unit also includes means located at the opposite sides of the supporting frame and engagable by the outer glass panel to prevent sidewise movement of said panel in said frame and for also facilitating the initial positioning of the said panel in the bottom channel.

DESCRIPTION OF THE PREFERRED EMBODIMENT

Figure 1:
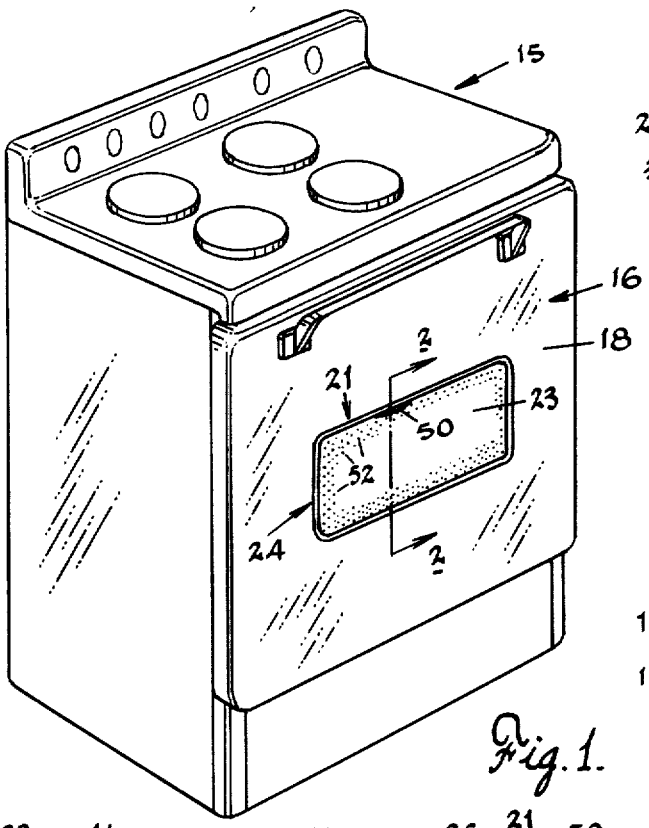
FIG. 1 is a perspective view of an oven range employing a window unit for the door constructed in accordance with the invention.

Referring now to the drawings, there is illustrated in FIG. 1, a floor standing range 15 employing an oven door 16 including front and back metal door panels 17 and 18 (FIG. 2) which are provided with aligned substantially rectangular openings defined by inwardly turned flanges 19 and 20 respectively and adapted to receive therein the novel window unit 21 of this invention. The window unit 21 comprises inner and outer transparent, tempered glass panels 22 and 23 mounted in spaced, parallel relation in a substantially rectangular frame 24.

The frame 24 may be formed of a suitable material, such as a light-weight metal, and is provided with two substantially continuous U-shaped channels 25 and 26 encircling the opening therein and separated by a divider 27. The outer legs 28 and 29 of the channels 25 and 26 are provided with integral facing strips 30 and 31 respectively.

The inner and outer glass panels 22 and 23 are received in the inner and outer channels 25 and 26 respectively. The inner glass panel 22 is fixedly secured in the channel 25, while the outer glass panel 23 is removably mounted in the channel 26. As pointed out above, the aim of this invention is to releasably mount the outer panel in the supporting frame such that it can be readily removed to permit cleaning of the inner surfaces of the panels or for replacement purposes.

In carrying out the invention, and in order to facilitate the insertion of the outer glass panel 23 is the supporting frame 24 and its removal therefrom, the said panel is of slightly less width than the opening in the said frame. Also, the vertical dimension of the outer glass panel is somewhat less than the distance between the bottom of the upper channel portion 32 and the bottom of the lower channel portion 33. This will allow the outer glass panel to clear the opposite sides and top of the supporting frame during insertion and removal of said panel, as will be more fully hereinafter described.

Figure 8:
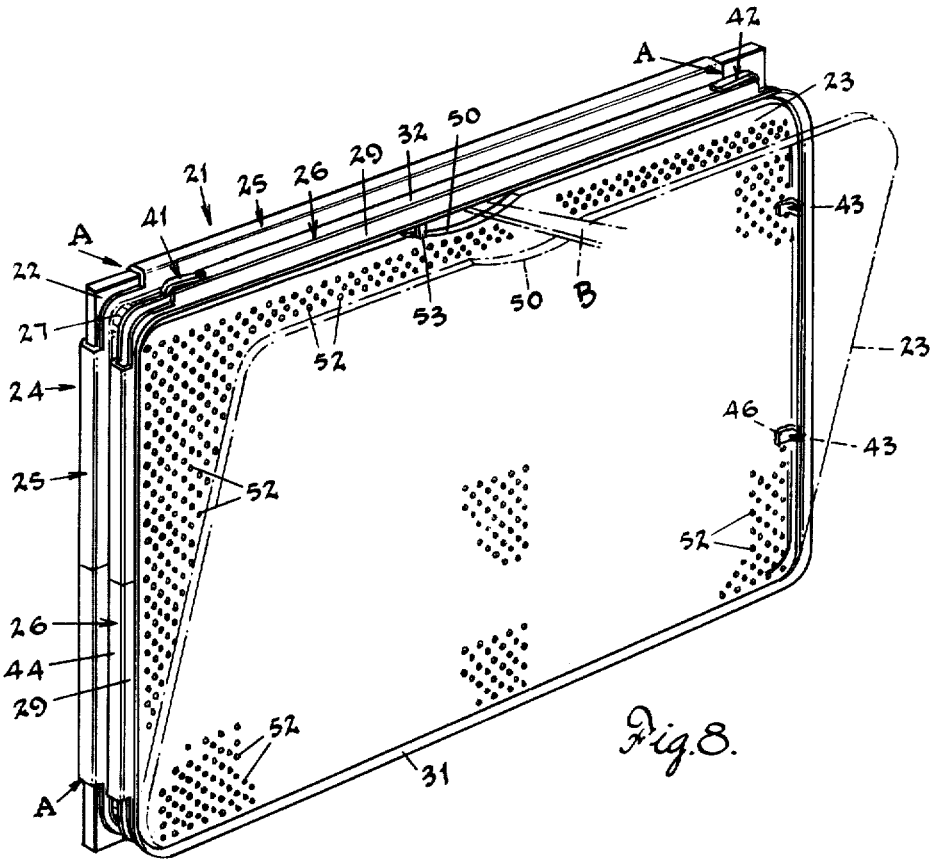
FIG. 8 is a perspective view of the window unit employing a preferred type of coated outer glass panel.
Figure 9:
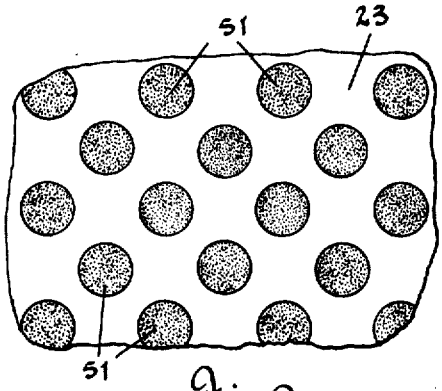
FIG. 9 is a plan view of a portion of the outer glass panel of FIG. 8, showing one step in the application of the coating thereto.
Figure 10:
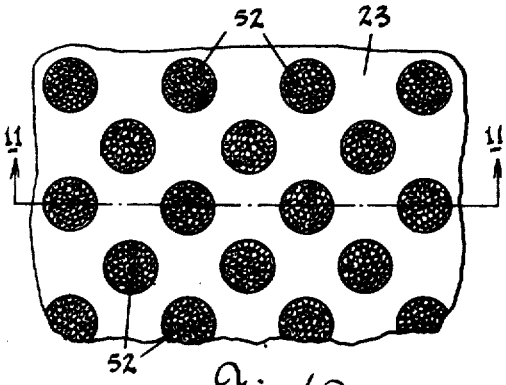
FIG. 10 is a plan view of a portion of the glass panel showing the finished coating.
Figure 11:
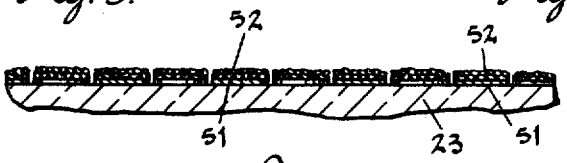
FIG. 11 is a sectional view of the coated panel taken substantially on line 11—11 of FIG. 10.

As best shown in FIG. 8, the substantially continuous U-shaped channels 25 and 26 are cut-away at the four corners of the frame 24, as indicated at A. This will permit the use of a substantially rectangular inner glass panel 22, with the corner portions thereof projecting through the cut-away areas. The corners of the outer glass panel 23 must, however, be rounded to permit the positioning thereof in the frame and its removal therefrom.

Figure 5:
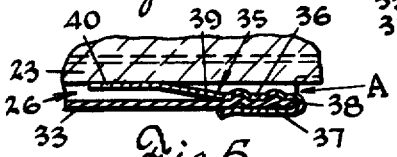
FIG. 5 is a detail sectional view of the spring means in the outer channel at the bottom of the supporting frame in depressed position during insertion of the outer glass panel in the frame.
Figure 7:
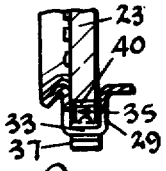
FIG. 7 is a detail section taken substantially on line 7—7 of FIG. 6.

In order to maintain the outer glass panel firmly, yet releasably, in position in the supporting frame, there is mounted in the bottom channel 33 suitable spring means which, for example, may consist of a pair of spring clips 34 and 35, each comprising a pair of spaced, substantially parallel legs 36 and 37 joined by an integral bight portion 38. When positioning the spring clips 34 and 35, each clip is slipped over one end of the bottom wall of the outer channel 33, with the leg 36 being located in the channel and the leg 37 beneath said channel. The spaced legs 36 and 37 exert a spring pressure on the bottom wall of the channel to hold the clips in place. The upper leg 36 of the spring clip includes an angled portion 39 terminating in a horizontal portion 40. When the outer glass panel is initially placed in the bottom channel portion 33 of the supporting frame, it will be supported on the horizontal portions 40 of the legs 36 of said spring clips 34 and 35 and will act to depress the said legs, as shown in FIG. 5. When the panel is then released the pressure exerted by the spring clips on the bottom peripheral edge of the glass panel will urge said panel upwardly into the upper channel 32 at the top of the frame.

Similiar spring clips 41 and 42, or other suitable spring means, may also be provided in the upper channel portion 32 to engage the top edge of the glass panel. By gripping the glass panel between the upper and lower spring means the possibility of accidental displacement or rattling of the panel will be minimized.

Figure 4:
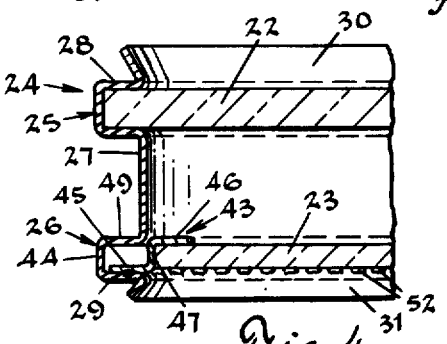
FIG. 4 is a horizontal section of a portion of the window unit taken substantially on line 4—4 of FIG. 3.
Figure 6:
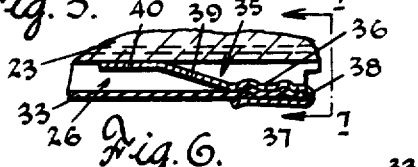
FIG. 6 is a similiar sectional view taken substantially on line 6—6 of FIG. 2 showing the position of the spring means after positioning of the glass panel in the frame.

The invention also comprehends means for facilitating the positioning of the outer glass panel in the supporting frame, as well as for preventing sidewise movement of the panel after it is positioned in said frame. Such means includes two, or more, substantially Z-shaped members 43 positioned in each side channel portion 44. Each member 43 comprises oppositely directed parallel legs 45 and 46 connected by an integral spacer portion 47. (FIG. 4) The outer leg 45 is in contact with the inner surface of the outer leg 29 of the side channel 44 and preferably spot welded thereto, while the inner leg 46 is directed inwardly in alignment with the inner leg 49 of said channel portion. When the glass panel 23 is initially placed in the frame, the back surface of said panel will engage the legs 46 of the Z-shaped members 43, while the peripheral sides edges thereof will engage the spacer portions 47 thereof.

Figure 2:
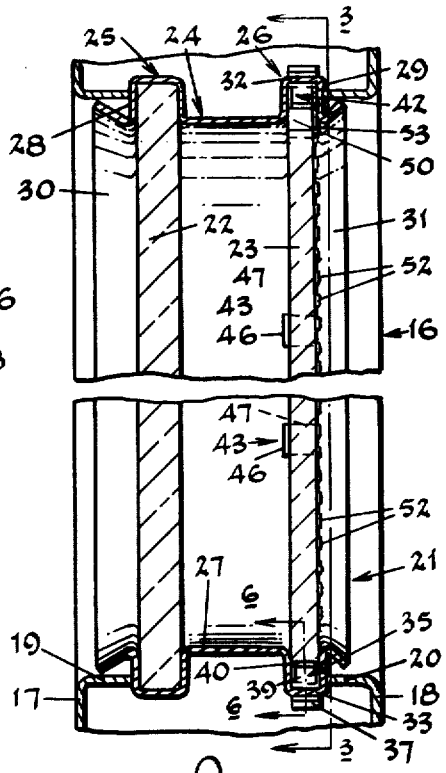
FIG. 2 is a vertical transverse section of the window unit taken substantially on line 2—2 of FIG. 1.

When inserting the outer glass panel in the supporting frame, the panel it tilted forwardly, as indicated by the broken lines in FIG. 8, and the bottom edge portion thereof placed in the bottom channel 33. The panel is simultaneously pushed downwardly with sufficient force to depress the legs 36 of the spring clips 34 and 35 to an extent sufficient to permit the upper edge of the panel to pass beneath the upper channel. The panel is then moved rearwardly to a vertical position and aligned with said upper channel 32. The panel is then released and the spring pressure of the clips 34 and 35 on the bottom edge of the panel will urge it upwardly with the upper marginal portion thereof being received in said upper channel and in engagement with the spring clips 41 and 42, as shown in FIG. 2.

The spacer portions 47 of the Z-shaped members 43, engaging the peripheral side edges of the panel, serve to prevent sidewise shifting of said panel in the frame, while the legs 46 of said members limit the rearward movement of the panel with respect to the frame during the initial portioning thereof.

While it is important that the outer glass panel be readily removable from the supporting frame for the purposes set forth above, it is equally important that it be securely held in the frame in such a way that it cannot be too easily removed and preferably not without the use of a suitable tool. To this end, the said panel is provided in its upper edge with a relatively shallow groove 50. When it is desired to remove the glass panel from the frame, a suitable tool B, indicated by the broken lines in FIG. 8, is inserted in the groove 50 and, by raising up on the outer end of said tool, the glass panel can be forced downwardly against the action of the spring clips 34 and 35 until the top edge of the panel is free of the channel whereupon the said panel can be readily tilted forwardly and lifted out of the bottom channel.

As noted above, it has been common practice in the past to provide a double-glazed unit as the window for the oven door comprising two glass panels mounted in fixed, spaced parallel relation in a metal frame to provide a dead-air space therebetween. The purpose of such a window unit is, of course, to retard the loss of oven heat and thereby maintain the temperature of the outer surface of the outer glass panel at an acceptable level. To further reduce the transmission of oven heat through the window, a thin transparent reflective metal coating has been applied to the inner surface of the outer glass panel. However, an even more effective means for solving this problem has been the application of a special type of coating to the outer surface of the outer glass panel.

Such a coating is illustrated in the drawings and will be hereinafter briefly described. While no claim is made in this application to the coating per se, the window unit of this invention is of particular utility when employed in conjunction with an outer glass panel having a heat radiating coating applied to the outer surface thereof, as will become more fully hereinafter apparent.

With reference particularly to FIGS. 8-11 of the drawings, there is applied to the outer surface of the outer glass panel 23 a plurality of small, discrete dots 51 of a ceramic paint. While the paint is still wet, a plurality of finely divided glass particles, such as glass beads, are sprinkled, or otherwise deposited, on the painted areas 51 in sufficient quantity to form a plurality of clusters or glomernates 52. The particle clusters are arranged in spaced, horizontal rows over substantially the entire area of the glass panel, with the clusters in adjacent rows being staggered and substantially uniformily spaced from one another. The open spaces between the glass clusters provide unobstructed viewing areas through which the interior of the oven can be readily observed. With this arrangement, the finely divided glass particles present a myriad of exposed minute surfaces that collectively provide a large radiating surface from which a maximum amount of heat emanating from the oven will be dispersed to the surrounding atmosphere. Such a coating has been found to be extremely effective in maintaining the temperature of the outer surface of the panel at an acceptable level.

The dots 51 of ceramic paint are preferably applied to the glass panel with a silk screen, using the squeegee technique. After the finely divided glass particles have been applied to the painted areas, the glass panel is placed in a furnace and heated to a temperature of about 1250° F. It is then removed and subjected to blasts of cold air to effect the tempering of the glass panel in a manner well known in the art. During heating, the ceramic paint becomes fired on the glass panel and the finely divided glass particles simultaneously fused to the paint and to one another. After the glass has cooled, the excess loose glass particles can be readily removed by brushing or by simply shaking the panel.

Figure 3:
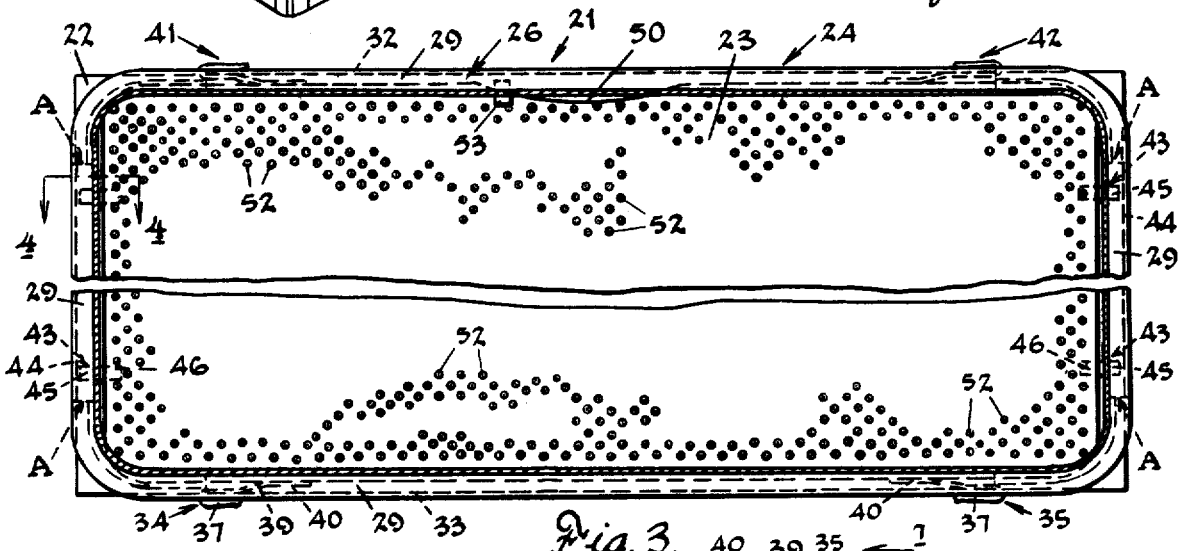
FIG. 3 is a vertical sectional view of the window unit taken substantially on line 3—3 of FIG. 2.

When employing a glass panel having a coating applied to the outer surface thereof, it is essential that, when the panel is to be replaced in the window frame 24 after cleaning of the inner surfaces of said panels, care must be taken to make certain that the panel is not inadvertently reversed which would, of course, destroy its effectiveness. The present invention contemplates the provision of positive means for preventing this from occurring. Such means comprises a depending finger 53 (FIG. 3) preferably spot welded to the outer leg 29 of the upper channel portion 32 of the frame. The finger 53 is laterally offset with respect to the center of the groove 50 in the top edge of the panel, the relationship between the finger and groove being such that when the panel is correctly inserted in the frame the finger will pass through the groove permitting the panel to be properly positioned in said frame. On the other hand, should an attempt be made to insert the panel in the frame with the coating facing toward the oven, the finger 53 will engage the back of the panel and prevent it from moving into position in the frame, thereby signaling that the panel is being improperly inserted and must be reversed.

It is to be understood that the present disclosure has been made only by way of example and that modifications and changes may be resorted to without departing from the spirit and scope of the invention as hereinafter claimed.

I claim:

1. An oven door comprising a main body portion having a substantially rectangular opening therein, a window unit mounted in said opening comprising a substantially rectangular frame having a window opening therein, said frame being formed with spaced inner and outer substantially continuous channels defining the window opening therein, inner and outer glass panels mounted in said inner and outer channels respectively in spaced, parallel relation and closing said window opening, said inner glass panel being fixedly secured in said frame, and means for releasably securing said outer glass panel in said frame.

2. The oven door of claim 1, in which the means for releasably securing the outer glass panel in the frame comprises means carried by said frame and engaging said glass panel.

3. The oven door of claim 2, in which said means comprises spring means located in said outer channel and engaging the lower peripheral edge of said outer panel to urge said panel upwardly.

4. The oven door of claim 3, in which the width of the outer glass panel is slightly less than that of the window opening in said frame, and including means carried by said frame and engaging the peripheral side edges of said outer glass panel to prevent sidewise movement thereof in the frame.

5. The oven door of claim 4, including means carried by said frame and engagable by the back surface of said outer glass panel for positioning said panel with respect to the outer channel when the said panel is initially inserted in the said frame.

6. The oven door of claim 3, in which said outer glass panel is provided with a relatively shallow groove in its upper edge to facilitate removal of the said panel from said frame.

7. The oven door of claim 1, in which said outer glass panel is provided with a relatively shallow groove in its upper edge, and means carried by said frame adapted to pass through said groove when the panel is properly inserted in the frame and to engage the panel when the said panel is not being properly inserted in the said frame.

8. The oven door of claim 4, in which said outer glass panel is provided with a relatively shallow groove in its upper edge, and means carried by said frame adapted to pass through said groove when the panel is being properly inserted in the frame and to engage the back surface of the panel when the said panel is not being properly inserted in the said frame.

9. The oven door of claim 7, in which the outer surface of the outer glass panel is provided with a heat radiating coating.

10. The oven door of claim 8, in which the outer surface of the outer glass panel is provided with a coating of discrete clusters of finely divided glass particles.

11. An oven door comprising a main body portion having a substantially rectangular opening therein, a window unit mounted in said opening comprising a frame provided with spaced inner and outer substantially continuous channels defining the window opening therein, inner and outer glass panels mounted in said window opening, the width of the outer glass panel being slightly less than that of the window opening in the frame and the vertical dimension of said outer glass panel being somewhat less than the distance between the bottoms of those portions of the outer channel at the top and bottom of the frame, said panel being inserted in said frame by initially placing the lower edge portion thereof in the outer channel at the bottom of the frame, and spring means carried by said frame for urging said panel upwardly and the upper edge portion thereof into the channel at the top of said frame.

12. The oven door of claim 11, in which said spring means is located in the outer channel at the bottom of the frame and engage the lower peripheral edge of said panel.

13. The oven door of claim 11, including means carried by said frame for preventing sidewise movement of the outer glass panel when positioned in said frame.

14. The oven door of claim 13, including means carried by the frame and engagable by said panel for positioning the said panel with respect to the outer channel at the bottom of the frame when the said panel is initially inserted in the said frame.

15. The oven door of claim 12, in which the outer glass panel is provided with a relatively shallow groove in its upper edge to facilitate downward movement of said panel against the action of the spring means in said bottom channel to enable removal of the upper edge portion of said panel from said upper channel and complete removal of the panel from the frame.

16. The oven door of claim 15, including means carried by said frame adapted to pass through said groove when the panel is being properly inserted in the frame and to engage the panel when said panel is not being properly inserted in said frame.

17. The oven door of claim 16, in which the outer surface of the outer glass panel is provided with a plurality of discrete clusters of finely divided glass particles adhered thereto.

* * * * *